US011130120B2

(12) United States Patent
Xiao et al.

(10) Patent No.: US 11,130,120 B2
(45) Date of Patent: Sep. 28, 2021

(54) MICRO-PIPETTE TIP FOR FORMING MICRO-DROPLETS

(71) Applicants: Lifeng Xiao, Markham (CA); Yuan Min Wu, Scarborough (CA); Yuanji Chen, Richmond Hill (CA)

(72) Inventors: Lifeng Xiao, Markham (CA); Yuan Min Wu, Scarborough (CA); Yuanji Chen, Richmond Hill (CA)

( * ) Notice: Subject to any disclaimer, the term of this patent is extended or adjusted under 35 U.S.C. 154(b) by 354 days.

(21) Appl. No.: 16/148,282

(22) Filed: Oct. 1, 2018

(65) Prior Publication Data

US 2020/0101454 A1 Apr. 2, 2020

(51) Int. Cl.
*B01L 3/02* (2006.01)

(52) U.S. Cl.
CPC ..... *B01L 3/021* (2013.01); *B01L 2200/16* (2013.01); *B01L 2300/165* (2013.01)

(58) Field of Classification Search
None
See application file for complete search history.

(56) References Cited

U.S. PATENT DOCUMENTS

2002/0076353 A1* 6/2002 Lehmann ..... G01N 35/028 422/68.1
2019/0185909 A1* 6/2019 Li ..... B01L 3/5027

* cited by examiner

*Primary Examiner* — Brian R Gordon
(74) *Attorney, Agent, or Firm* — Nasser Ashgriz; UIPatent Inc.

(57) ABSTRACT

A micro-droplet-emulsifier to generate a micro-droplet-emulsion for application on digital polymerase chain reaction is provided. This device includes a micropipette to hold a dispersed-phase-liquid; a droplet generator that attaches to the micro-pipette and has a plurality of substantially flat micro-channels. The dispersed-phase-liquid is forced through the micro-channels to form micro-droplet-emulsion of dispersed-liquid-phase in the continuous-liquid-phase inside the chamber. The size of the micro-droplets is controlled by the shape and the aspect ratio of the micro-channels, the depth of the micro-channels and the material of the micro-droplet-generator-head that dictates the contact angle of the droplet on the micro-channels.

14 Claims, 12 Drawing Sheets

MICRO-PIPETTE TIP FOR FORMING MICRO-DROPLETS

FIELD OF THE INVENTION

The present invention relates generally to a device for emulsification, and especially to a device to form a uniform micro-droplet for Digital PCR.

BACKGROUND OF THE INVENTION

Digital polymerase chain reaction (dPCR) is a system to directly quantify and clonally amplify nucleic acids, e.g., DNA, cDNA or RNA. Conventional PCR is generally used for measuring nucleic acid amounts and is carried out by a single reaction per sample. Utilizing dPCR methodology, a single reaction is also carried out on a sample, however the sample is separated into a large number of partitions and the reaction is carried out in each partition individually. This separation allows for a more reliable collection and sensitive measurement of nucleic acid amounts.

In dPCR, a sample is partitioned so that individual nucleic acid molecules within the sample are localized and concentrated within many separate regions. The capture or isolation of individual nucleic acid molecules can be performed in micro well plates, capillaries, the dispersed phase of an emulsion, and arrays of miniaturized chambers, as well as on nucleic acid binding surfaces. The partitioning of the sample allows one to estimate the number of different molecules by assuming that the molecule population follows the Poisson distribution. As a result, each partitioned sample will contain "0" or "1" molecules, or a negative or positive reaction, respectively. After PCR amplification, nucleic acids can be quantified by counting the regions that contain PCR end-product, positive reactions. In conventional PCR, the number of PCR amplification cycles is proportional to the starting copy number. dPCR, however, is not dependent on the number of amplification cycles to determine the initial sample amount, eliminating the reliance on uncertain exponential data to quantify target nucleic acids and therefore provides absolute quantification.

The present invention aims to form emulsified micro-droplet applied to Droplet Digital PCR. During droplet generation, uniformity of droplets is difficult to control. Digital PCR usually needs very small size droplets, which may act as micro-reactors. Many factors may impact on the quality of droplet formation. In PCR, droplet size usually ranges from 10~500 μm, and the preferred number of droplets is less than 10,000,000, otherwise, the cost of detection will be high. As consumables, the manufacturing cost of the droplet generator can block its application to digital PCR. Thus, this invention gives a new approach to generate droplets with high uniformity, high efficiency, low cost and much more simplicity.

Since digital PCR was presented, hundreds of methods and devices had been invented. Typical device is ddPCR from BioRAD, USA. ddPCR introduced a microfluidic channel with cross flow to generate droplets. A similar method is used in RainDrop dPCR system, which also utilizes the microfluidic channel to generate droplets for PCR. STILLA's Naica system employs a special geometric structure in a microfluidic chip to generate a large number of uniform droplets. These devices are typical products in current digital PCR market, and they all utilize a form of micro-chip to support their sample dispersion.

The previous methods have utilized either a shear force to generate droplets or a spontaneous droplet generation method. Many have used a cross flow to cut off the continuous phase into a dispersed phase. Some methods rely on the geometric structure of the micro-channel, which applies pressure on the dispersion phase to self-break into droplets. The later method consumes less energy and it is easier to control.

A large number of prior art devices uses the above methods. For example, U.S. Pat. No. 6,281,254 uses a stepped structure to spontaneously generate droplets. In such a chip, a micro-channel with a certain aspect ratio is formed with an aligned dock in between the two layers. When liquid thread flows through the channel, the volume change causes the stream to breakup and form a series of droplets.

CN107427788A and JP2018511466A also use a stepped structure in their chips to realize the droplet generation. Compared to the traditional one step structure, this device has multiple steps.

US20130078164A1 and US20150258543A1 utilize an inclined slope in a channel structure, with a continuous geometric change. In this case the surface tension will break the flatten thread into a series of droplets. U.S. Pat. No. 9,816,133 constructs a group of such a channel for mass production of droplets. Similar method are used in US20080314761A1 and US20180085762A1.

Most prior art systems have constructed micro-channels in a chip. Therefore, this kind of emulsification are referred to as step emulsification or micro-channel emulsification. This type of flat channel structure can also be used in membrane. US20090264550 present a manufacturing method to thermal stretch a membrane, which can cause the deformation of the original micro-channels into a flatten micro-channels, such as a box into a rectangle or a circle into an ellipse.

The prior art is mainly based on a geometric structure with a specific aspect ratio. With such a structure, surface tension is a major power to generate droplet. Without a cross flow, only one-way energy input is required to apply on the dispersed phase, and droplet size and uniformity only relies on the geometric parameters.

The problems associated with currently available devices and inventions is that they all have implemented the spontaneous droplet formation method on a micro-chip. However, the manufacturing of such micro-chips is costly, resulting in expensive final products.

The present invention provides a simple method of generating small droplets, without requiring for a complex microfluidics technology. The present invention utilizes modified traditional pipette tips, which are used to transfer fluids to the PCR devices. Pipette tips are inexpensive and commonly used in most medical and biological application. The present invention can effectively upgrade the traditional regular quantitative PCR device into a digital PCR instrument. With the micro-pipette tip presented by this invention can easily generate uniform droplets and operate a thermal cycle. Together with a monolayer image processing method, the total cost of the digital PCR will be significantly lower.

SUMMARY OF THE INVENTION

A micro-droplet emulsifier for generating micron size droplet emulsions is disclosed. The micro-droplet emulsifier comprises of a micro-pipette, a micro-droplet generator head that is attached to the micro-pipette, and a continuous-phase liquid chamber, in which the emulsion is formed. The micro-droplet generator head comprises of a plurality of flat micro-channels that form droplets as the liquid passes through them. In order to fit the droplet generator head onto the micro-pipette, a traditional pipette tip is cut to enlarge the end orifice. Any size micro-pipette can be manufactured having a desired exit orifice.

The micro-droplet generator head comprises of a plurality of flat micro-channels. Flat is defined at a cross sectional shape that has a large aspect ratio, namely a large length to width.

In one embodiment of the present invention, there only one series of micro-channels. And in another embodiment, each micro-channels opens into a larger-micro-channel or pores. This is achieved by bonding two different membranes onto each other. One membrane has the smaller micro-channels and the other has the larger ones. By aligning the channels and bonding the two membranes, a two-chamber system of the present invention is constructed. The micro-channels are flat (in a slit form or elongated).

In another embodiment of the present invention, the micro-channels in the second membrane are overlaid on the micro-channels in the first membrane in a cross direction. When a liquid stream flows into such a cross-channel system, the stream pinches off rapidly because of significant droplet deformation.

This invention is mainly applied in the droplet formation of digital PCR application. There is no prior art based on pipette tip for digital PCR products. Both a manual operation and an automation control are easily realized. A single tip or multiple tips can be used to implement the batch droplet formation.

The present device can be used for genetic testing, medical and biological research Labs, and clinical diagnosis for genetic diseases and cancers.

One objective of the present invention is to provide a device to be used in digital PCRs. Compared with the current spontaneous emulsification, this invention, based on the micro-pipette tip, makes it possible to upgrade a traditional qPCR into a digital PCR, making the droplet generation more flexible in the specific application, lower the cost of the digital PCR. With a pipette tip with droplet formation function, PCR application becomes more extensible for manual operation in the lab or automatic operation in mass analysis.

Another objective of the present invention is to provide a low cost, fast, more flexible, and easy to operate device for digital PCR.

Another objective of the present invention is to provide an easy way to realize the droplet formation, minimize the cost for digital PCR, maximize the application of digital PCR, and integrate traditional qPCR system easily.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

The Figures are not intended to be exhaustive or to limit the present invention to the precise form disclosed. It should be understood that the invention can be practiced with modification and alteration, and that the disclosed technology be limited only by the claims and equivalents thereof.

The technology disclosed herein, in accordance with one or more various embodiments, is described in detail with reference to the following Figures. The drawings are provided for purposes of illustration only and merely depict typical or example embodiments of the disclosed technology. These drawings are provided to facilitate the reader's understanding of the disclosed technology and shall not be considered limiting of the breadth, scope, or applicability thereof. It should be noted that for clarity and ease of illustration these drawings are not necessarily made to scale.

Figure 1:
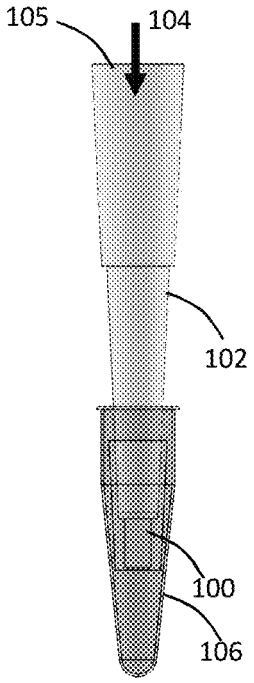
FIG. 1 is a micro-droplet emulsifier of the present invention.

This invention presents a method to realize micro-droplet emulsions using a micro-pipette. FIGS. 1-3 show a micro-droplet generator 100 that is attached to the tip of a micro-pipette 102. A dispersed phase liquid 104 is forced through the micro-pipette 102 and the micro-droplet generator 100 to form micro-droplets inside a pipette cap 106 or any chamber containing the continuous phase liquid.

In order to make this device, a standard 200 μl pipette 102 is cut off from the end orifice to form a circular cross section of at least 3 mm in diameter. Any other size pipettes, including 10 μl, 20 μl, 50 μl, 500 μl and 1 ml in volume, can also be used. The micro-pipette can have an outlet including a diameter of at least 1 mm. Then, a micro-droplet-generator-head 310 (FIG. 3A) is attached to the tip of the micro-pipette 102 with an attachment system, such as bonding, press fit, etc. The micro-droplet-generator-head is basically a microfluidic socket head or a membrane with specific structure that has a plurality of flat micro-channels 206. The micro- channels have a large aspect ratio (length /width) with a length in a range of 10 to 200 microns, a width is in a range of 1-100 microns, and the depth (or the thickness) of the micro-channel is in a range of 10-500 microns. The number of micro-channels might be from one to several hundred according to the required droplet diameter. There are no other requirements for the micro-channel pattern except that the spacing of micro-channel need to satisfy the minimal distance to avoid the coalescence of the adjacent droplets or interruption of droplet formation. A spacing between two neighboring micro-channels is at least 2 times, and preferably 3 to 5 times, of a predetermined diameter of a micro-droplet.

Figure 2A:
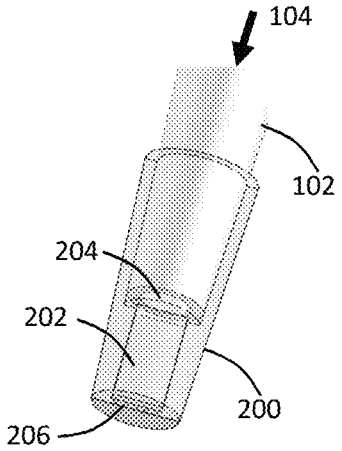
FIG. 2A shows a micro-droplet-generator-head attached to a pipette.
Figure 2B:
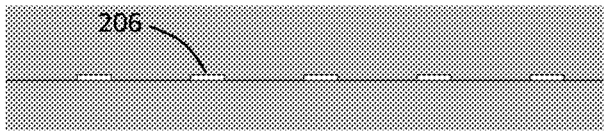
FIG. 2B shows a set of flat micro-channels at the bottom-wall of the micro-droplet-generator-head.
Figure 3A:
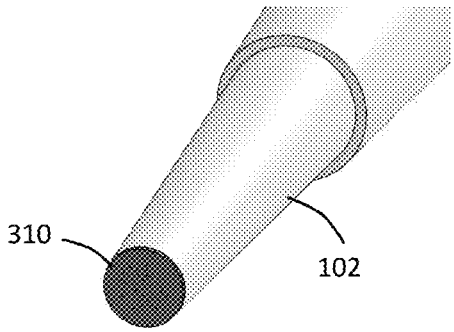
FIG. 3A is a perspective view of the micro-droplet-generator-head.
Figure 3B:
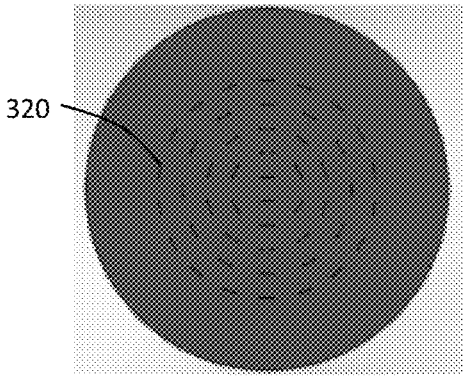
FIG. 3B shows the bottom wall of the micro-droplet-generator-head with a pattern of flat micro-channels.

FIG. 2A shows the micro-droplet-generator-head 200 that comprises of a socket 202 that is open from the top inlet side 204 and has a plurality of channels at its outlet side 207. The channels 206 are shown in FIG. 2B. Front views of the channels are shown in FIGS. 3A and 3B. The channels are generally elongated to force the liquid out of its equilibrium spherical shape. When a liquid is forced through a non-circular channel, it exits as a noncircular liquid mass. A non-circular mass of liquid is unstable and quickly deforms under the action of the surface tension forces. Since the surface tension forces are inversely related to the curvature of the jet (i.e., $\sigma/r$, where $\sigma$ is the coefficient of the surface tension of the liquid and r is the curvature of the liquid ligament), the narrower the liquid mass, the faster the deformation. Therefore, micro-channels with large cross-sectional aspect ratio are provided.

Figure 4:
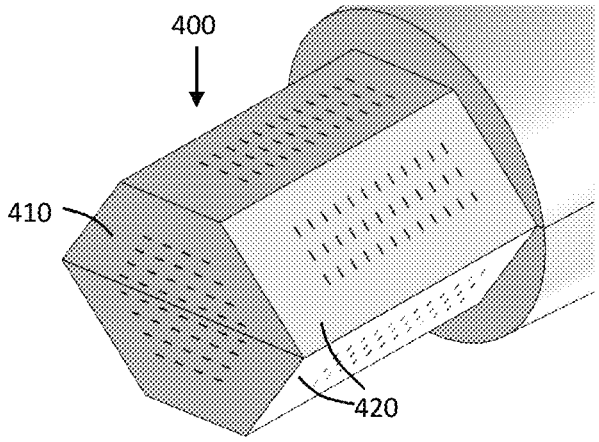
FIG. 4 shows a high throughput capillary tip.

Another embodiment of the present invention with high throughput is shown in FIGS. 4A, 4B, and 4C. In this case, the tip 400 has several walls: a bottom wall 410, and several side walls 420. Orifices are constructed on all surfaces to allow for high rate of droplet generation.

Figure 5A:
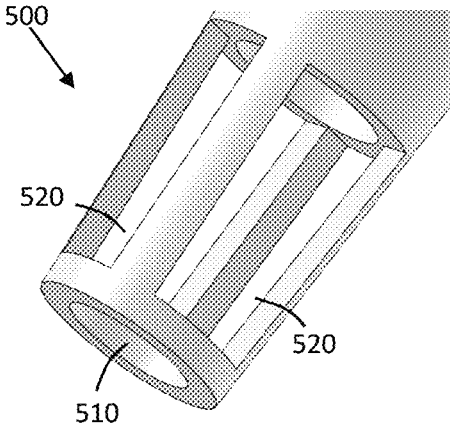
FIG. 5A shows capillary tip structure for the membrane support on the profile surface.
Figure 5B:
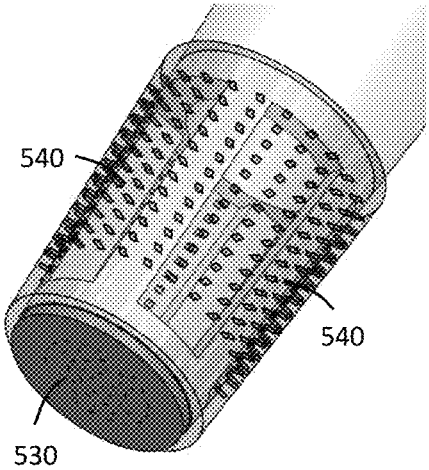
FIG. 5B shows the flat micro-channel array on the profile membrane.
Figure 6:
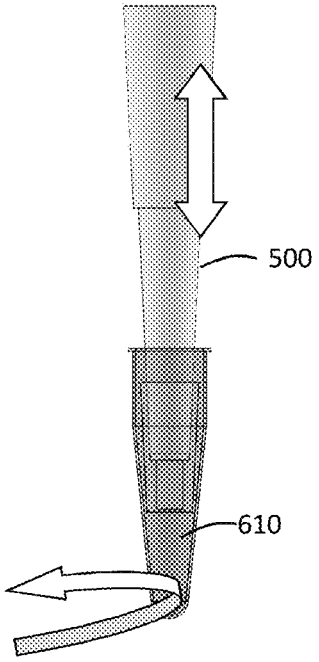
FIG. 6 shows the attachment method of the tube and the tip, either tube rotating or tip move up and down.

FIG. 5 shows another embodiment of the present invention. The micro-pipette 500 is cut to have a bottom opening 510 and several side openings 520. A bottom membrane 530 with micro-channels and several side membranes 540 with micro-channels are inserted into the micro-pipette openings. This provides an integrated micro-pipette with micro-droplet generator. Once the micro-channels are installed onto the micro-pipette, a pipette tip 610 is inserted onto the micro-pipette 500 and turned to lock-in position as shown in FIG. 6. By injecting the aqueous liquid through the micro-pipette, emulsified droplets are formed inside the pipette tip.

Figure 7A:
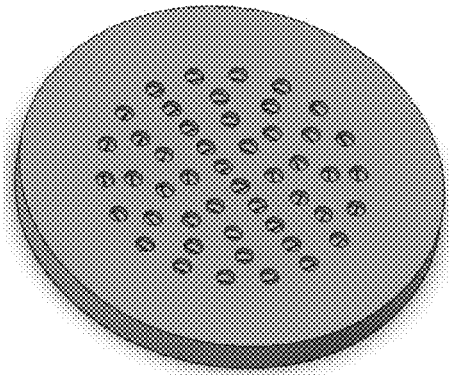
FIG. 7A shows the double face etching pattern with circle channels and circular pores of Pattern.
Figure 7B:
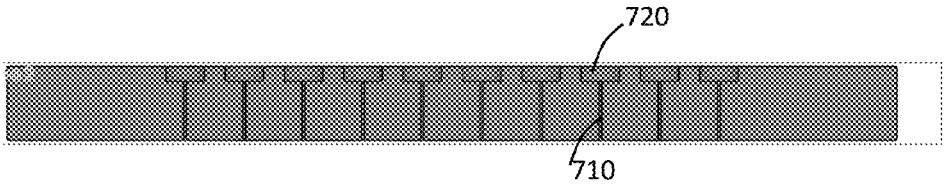
FIG. 7B shows the cross-sectional view of the circular pores.
Figure 7C:
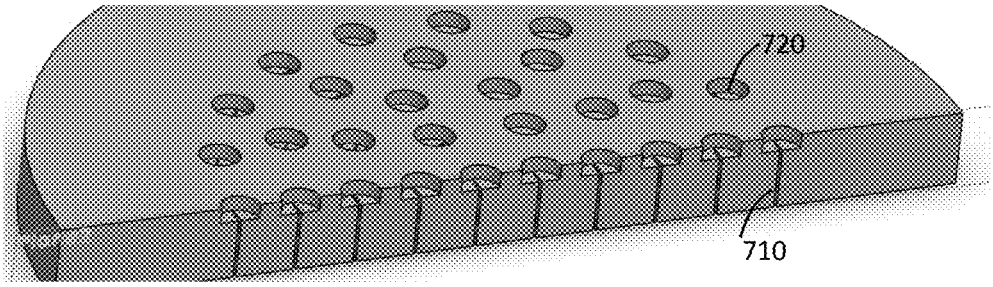
FIG. 7C shows the isometric view of the cross section of the circular pores.
Figure 8A:
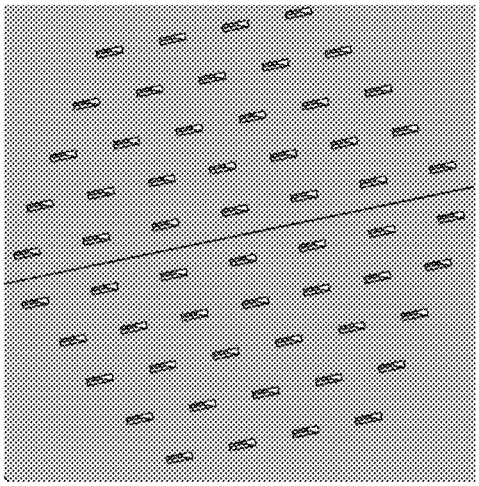
FIG. 8A shows the double face etching pattern with rectangle stepped pores.
Figure 8B:
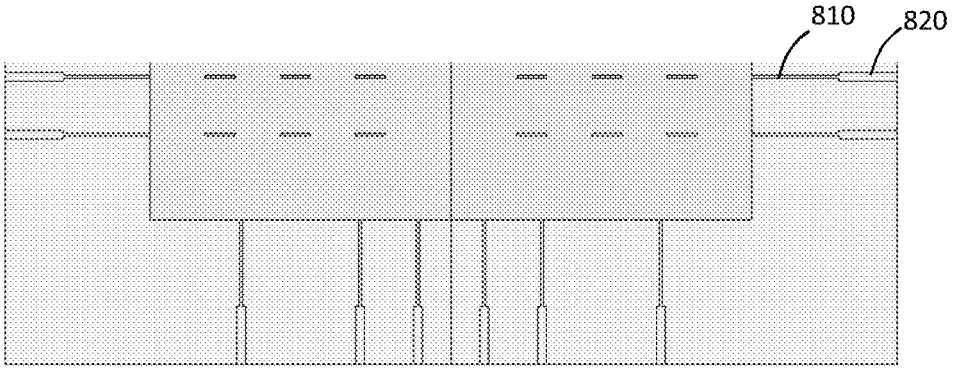
FIG. 8B shows a cross sectional view of the rectangle pores.
Figure 9A:
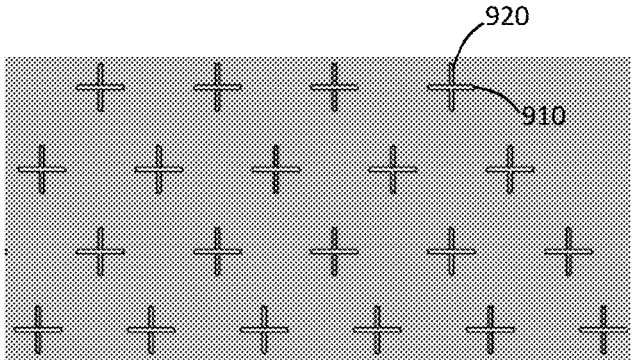
FIG. 9A shows a Double Face Etching Pattern with Cross Stepped Pores.
Figure 9B:
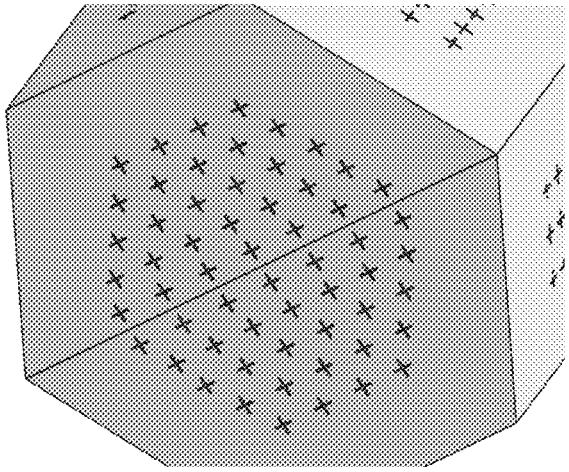
FIG. 9B shows a Cross Section View from Crossed Pores.
Figure 9C:
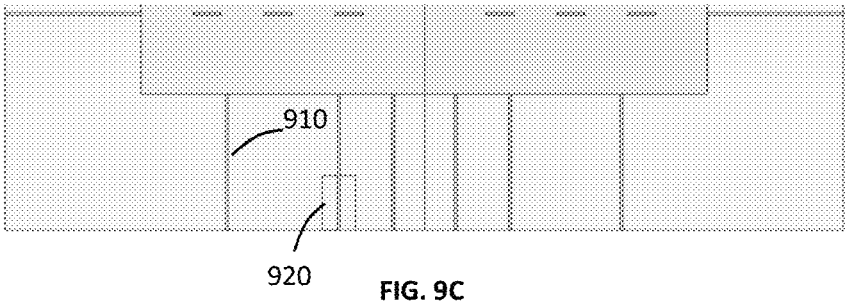
FIG. 9C shows Cross Section View from Crossed Pores in a first plane.
Figure 9D:
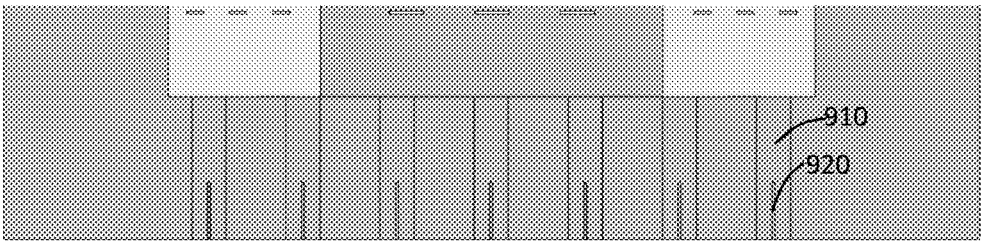
FIG. 9D shows Cross Section View from Crossed Pores in a second plane.
Figure 10A:
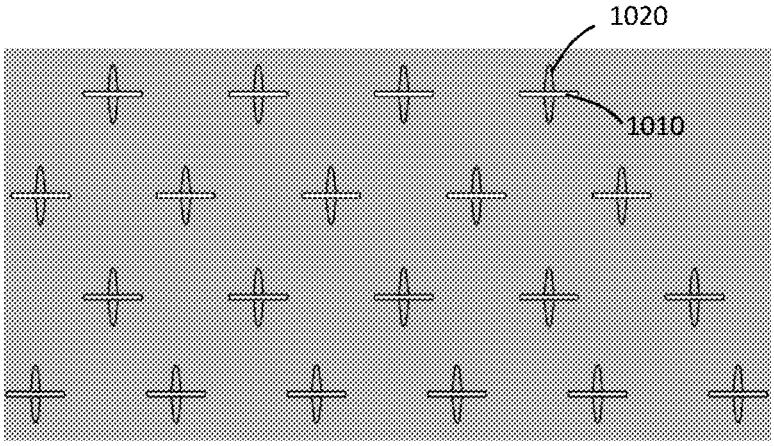
FIG. 10A shows Top View of the Combo Crossed Pores of Pattern 6.
Figure 10B:
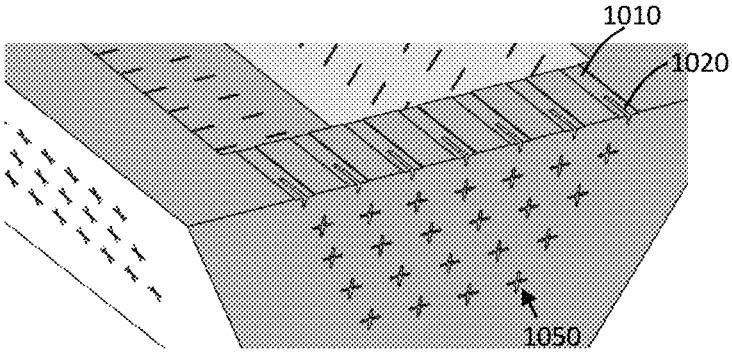
FIG. 10B shows Cross Section Isometric View from combo pores of pattern 6 at Plane 6.

Another embodiment of the present invention is a step emulsification based Pattern as shown in FIGS. 7 and 8. FIG. 7 shows that at the end of each of the flat micro-channels 710, a slightly larger cylindrical channel 720 is designed, which helps in the droplet pinch-off. The step-structural micro-channels on the membrane can be etched to reach the instability effect making the droplets fall off from the tip spontaneously. In order to make the stream pinch off, the cross section area of the larger channel shall be at least 2 times than the area of the smaller one. FIG. 8 shows a larger rectangular channel 820, at the end of each micro-channel 810.

FIGS. 9A-D and 10A-B show another embodiment of the present invention using two crossed channels. The first channels 910 and 1010 start from the insider of the micro-droplet-generator-head to form large aspect ratio liquid flows. These larger aspect ratio aqueous liquid flows suddenly enter into secondary channels 920 and 1020 that is in the cross direction with respect to the first channel 950 and 1050. Therefore, the central part of the liquid is forced into a cross direction forming a cross-shaped liquid flow. At the exit of the nozzle, a liquid flow having a cross-shape cross-section is generated. Therefore, the surface tension forces push the liquid inward from the larger curvature regions tending to pinch off the droplet. Since there are now four corners in the liquid attachment point, the pinch off occurs rapidly and a small droplet is formed.

Figure 11A:
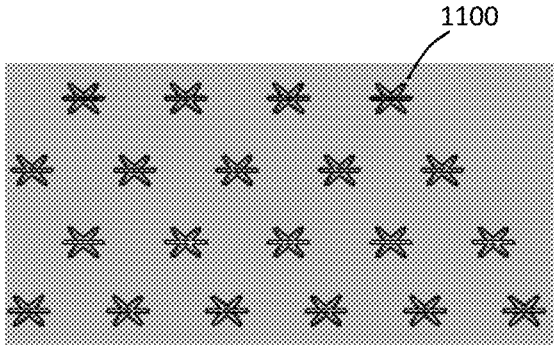
FIG. 11A shows Top View of the Combo Crossed Pores of Pattern 7.
Figure 11B:
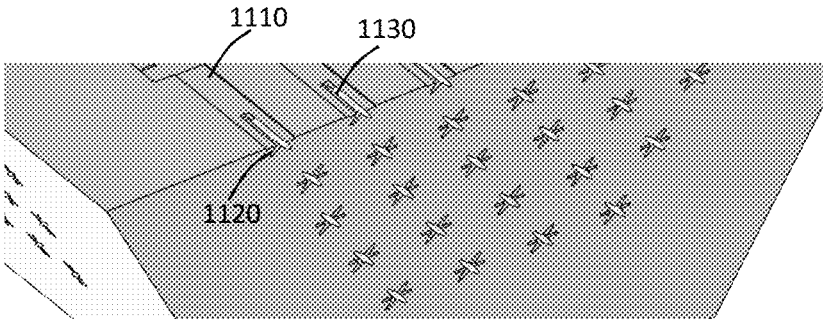
FIG. 11B shows Cross Section Isometric View from combo pores of pattern 7 at Plane 6.

FIG. 11A-B show another embodiment of the present invention using a star shaped channel 1100. In this configuration the liquid exits with a star shape, having six high curvature corners. Each micro-channel 1110 crosses two other micro-channels 1120 and 1130 that form a star shaped cross section together with the original micro-channel 1110. Therefore, the pinch-off process is further expedited, forming even smaller droplets.

Figure 12A:
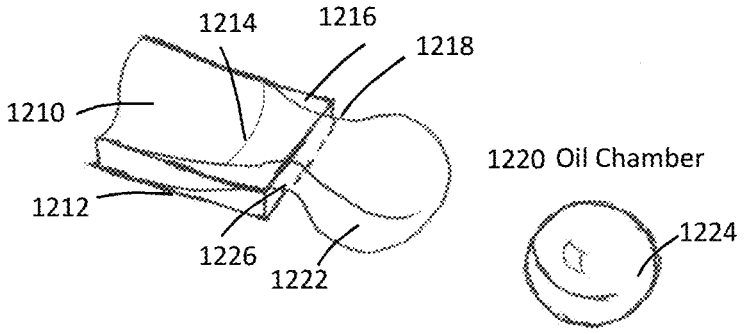
FIG. 12A shows the process of droplet formation in the present device.
Figure 12B:
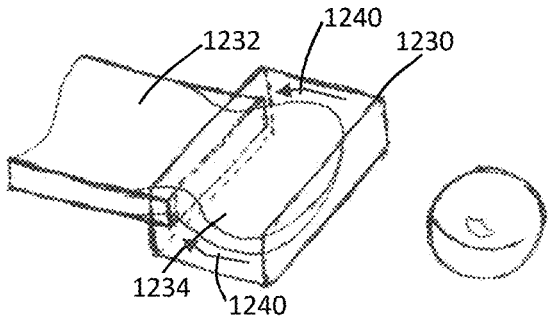
FIG. 12B shows the process of droplet formation in the present device.
Figure 12C:
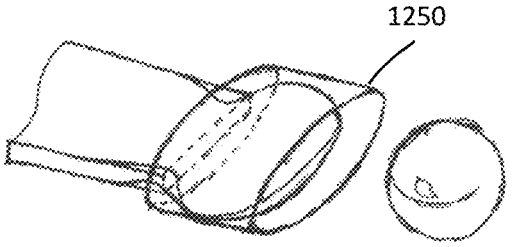
FIG. 12C shows the process of droplet formation in the present device.

The process of droplet formation in the present micro-channels are shown in FIG. 12A-C. FIG. 12A shows the aqueous flow 1210 inside the microchannel 1212. Because of the large aspect ratio of the channel, a parabolic flow 1214 is formed inside the channel. Because of the continuous phase is oil, which has a higher viscosity than water, once oil 1216 enters the channel, it may remain there forming a spindle type deformation zone 1218 on the liquid, from the inside of the channel and extending to the outside of the channel. Therefore, the aqueous flow becomes parabolic. It is also possible that no oil enters the channel, and the channel is filled with aqueous liquid. Once aqueous liquid enters the continuous oil base liquid chamber 1220, the surface tension forces tend to make the pendent drop 1222 to breakup and become a spherical micro-droplet 1224. Since the neck region 1226 of the attached drop is small, the drop can easily detach from the nozzle forming a droplet inside the oil.

In another embodiment of the same device, as depicted in FIG. 12B, it is found that by having a slightly larger channel 1230 at the exit of the smaller channel 1232, the droplet shape is forced to remain ellipsoidal 1234 until it become about the size of the larger channel 1230. The reason for this that the oil inside the larger channel 1240 prevents the droplet to become spherical. As the top of the drop, which is open to the oil reservoir of the pipette tip, becomes more spherical, the bottom and the attached part remains ellipsoidal, since the oil is trapped under the drop and prevents growth of the drop in all directions. This double chamber system expedited droplet separation, and therefore, results in the formation of smaller droplets in oil. FIG. 12C shows another embodiment of the same invention using an ellipsoidal or oval shaped larger chamber 1250. Similar effects as described for FIG. 12B results in the rapid breakup of the micro-droplets from the core liquid.

Aspect ratio of the micro channel is defined as the length of channel over the width of the channel, if the length of the channel is 140 microns, and the width of the channel is 4.3 microns, the aspect ratio will be 32.6. the range of aspect ratios are greater than 3.0, they may be in the range of 3 to 40.

The size and the shape of the channels are designed to facilitate the breakup of the liquid into droplets as soon as the liquid exits the channels. The number and spacing's of the channels are also determined to prevent the coalescence of the droplets as they form. If the channels are too close to each other the droplets will touch and coalesce. The spacing in between micro pores is determined by the droplet diameter, and it is greater than 2 times of the droplet diameter, and preferably 3~5 times of the droplet diameter. Also the number of droplets generated per unit area is in the range from 10~20,000 per square centimetre for the droplet diameters in the range of 5 microns to 200 microns.

Because of small size of the micro-channels, external liquid cannot be drawn back into the tip. Therefore, the continuous phase liquid is injected into the tip from the other opening end 105 to fill the pipette cap or the chamber.

While a dispersed phase liquid is injected into the tip, the air lock resists the injection of the liquid to fill the tip. Therefore, an external pressure is required to drive the liquid flow and venting out the remaining air in the tip and making the liquid reach the inner surface of micro pores of the socket head. It is noted that the depth of the micro channels are far less than the depth of the tip, and the volume of the remaining air in the micro channel is negligible.

Once the micro-pipette is filled with the dispersed phase liquid, the tip is immersed into a chamber, such as a pipette cap, that contains the continuous phase liquid, after air is vented out. Keeping the pressure to drive the dispersed phase into the flat micro-channels, the liquid will be self-broken into micro-droplets to form a emulsified droplet when in contact with the continuous phase. The micro-droplets may flow to the bottom of the tube by gravity.

Micro-droplets can be generated at a wide range of flow rates, varying from 1 to 100 microliter/min. The flow rate of the dispersed phase can be easily changed by changing the pumping rate of a pump, and without affecting the drop size. The number and generation rate of the micro-droplets depends on the emulsification performance of the continuous phase, droplet size and number of the micro-channel. For example, a single micro channel of aspect ratio in the range of 3.0 to 20, can generate droplet diameters in the range of 50~300 microns with frequencies in the range of 5~30 Hz. Usually, with the same channel size and the same time, the stepped combo channel generates more droplets than simple micro channel, and the star shape combo channel generates more droplets than the stepped combo channel.

The size of the micro-droplets that are formed depend on the following factors: (i) The material of the droplet generator that dictates the contact angle of the droplet at the exit of the channel, preferably hydrophobic; (ii) the shape of the micro-channel, preferably flatten shape such as rectangle or ellipse; (iii) the aspect ratio of the cross section of micro-channel, preferably greater than 3:1; (iv) the depth of micro-channel, enough for the self-breakup in the channel.

The table below shows the range of nozzles that can provide proper droplets.

| Length μm | Width μm | Depth μm (oval) | Depth μm (rectangle) | Contact Angle | Droplet Diameter (Oval) μm | Droplet Diameter (Rectangle) μm |
|---|---|---|---|---|---|---|
| 120 | 15 | 160 | 200 | 127.5 | 75 | 90 |
| 120 | 10 | 130 | 180 | 120 | 60 | 75 |
| 120 | 18 | 170 | 200 | 132 | 80 | 90 |
| 120 | 20 | 170 | 200 | 135 | 85 | 95 |
| 120 | 16 | 160 | 200 | 129 | 75 | 90 |
| 130 | 10 | 200 | 280 | 115 | 75 | 90 |

The main principals of the droplet formation in the present micro-channel device are as follows: By forcing a liquid through a straight through micro-channel, droplets are formed at the exit of the pores. This is referred to as Edge Based Droplet Generation. Droplets may fall to the bottom of the pipette tip by the force of gravity (since aqueous droplets are heavier than the surrounding oil). Since droplets may stick to the exit of the pores, an external flow may be needed to separate the droplets from the pore surfaces or dispersed them in the continuous phase. This can be achieved, by simply shaking the pipette, which make the droplets fall off from the tip.

After droplets are formed, the tube containing the droplets can be heated and amplified in thermal cycling machine. Then the amplified emulsion will be poured into a reader chip. The reader apparatus is usually composed of air pressure control system, optical imaging capture and mono-layer chip in which all the droplets are introduced into the observe area under the control of air pressure of inlet and outlet. In order to keep the fluid at the edges of the system and the center line moving in a perpendicular line, the shape of the edge is modified as a curve edge to slower the edge flow rate.

The detail operation for optical observation is that the tube is firstly placed in a holder and then the cover is opened after the temperature returns room temperature. Taking a reader chip to cover the tube completely and assemble the holder and chip together.

The combined chip is inclined inversely and the emulsion in the tube will flow into the chip reader. With the control of the air pressure at the outlet, all emulsion will pave in the mono-layer observation area. An optical image camera scans whole observation area and gives an absolute quantitative analysis report. Based on such a capillary tip, regular quantitative PCR can be easily upgraded into absolute quantitative PCR.

Replacing the traditional pipette tip with capillary tip, the sample will be dispersed into a standard tube and thermal cycling in traditional qPCR device, just with the utilization of a unique mono-layer imaging process, an absolute quantitative PCR is simply realized.

This invention provides a feasible way to upgrade a regular quantitative PCR into a droplet digital PCR, only adding an extra droplet reader unit. This invention will lower the user's investment and make an effective use of the existing instruments.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A micro-droplet-emulsifier to generate micro-droplet-emulsions for application on digital polymerase chain reaction, comprising:

a) a micro-pipette having an inlet and an outlet;

b) a micro-droplet-generator-head sealably attached to the outlet of the micropipette, and has a plurality of micro-channels, wherein each of the plurality of micro-channels comprises a primary-micro-channel and a secondary-micro-channel connected to the primary-microchannel, and wherein the secondary-micro-channel is in a cross direction with respect to the primary-micro-channel, and wherein each primary-microchannel has a depth and a cross-sectional shape that has a length and a width;

c) a cap or a cover or a closed chamber attached to and locked on the outlet of the micro-pipette to cover the micro-droplet-generator-head and wherein the cap or the cover or the closed chamber has a volume to receive and to contain a continuous-phase-liquid, whereby a dispersed-phase-liquid is forced through the micro-droplet-generator-head and flows through the plurality of micro-channels to generate a plurality of micro-droplets of the dispersed-phase-liquid in the continuous-phase-liquid inside the cap or the cover or the closed chamber and whereby a size of each micro-droplet is controlled by the cross-sectional shape, and the depth of each primary-micro-channel, and a contact angle of each micro-droplet that is defined by a material of the micro-droplet-generator-head.

2. The micro-droplet emulsifier of claim 1, wherein each primary-micro-channels opens to a pore, wherein each pore is configured to allow the formation of the micro-droplet-emulsions, each micro-droplet-emulsion having a diameter, and wherein each pore is cylindrical, ellipsoidal, or rectangular.

3. The micro-droplet emulsifier of claim 1, wherein each of the plurality of micro-channels further comprise a tertiary-micro-channel, wherein the secondary-micro-channel, the tertiary-micro-channel and the primary-micro-channel cross each other.

4. The micro-droplet-emulsifier of claim 1, wherein the micro-droplet-generator-head has a flat bottom-wall and wherein the plurality of micro-channels are made in the flat bottom-wall.

5. The micro-droplet-emulsifier of claim 1, wherein the micro-droplet-generator-head has a flat bottom-wall and a plurality of side walls, and wherein the plurality of micro-channels are made in the bottom-wall and in the plurality of side walls.

6. The micro-droplet emulsifier of claim 1, wherein the outlet of the micro-pipette has a diameter of at least 1 mm.

7. The micro-droplet emulsifier of claim 1, wherein the micro-pipette has a volume in a range of 10 microliter to 1 milliliter.

8. The micro-droplet emulsifier of claim 1, wherein the length is in a range of 10 to 200 microns, the width is in a range of 1-100 microns, and the depth is in a range of 10-500 microns.

9. The micro-droplet emulsifier of claim 1, wherein the cross-sectional shape of each of the primary-micro-channels is rectangular or ellipsoidal.

10. The micro-droplet emulsifier of claim 1, wherein an aspect ratio for of each primary-micro-channel is defined as the length divided by the width of the respective primary micro-channel and is in the range of 3-40.

11. The micro-droplet emulsifier of claim 1, wherein the micro-droplet-generator-head is made of a hydrophobic material.

12. The micro-droplet emulsifier of claim 1, wherein the number of the plurality of micro-channels of the micro-droplet-generator-head is in the range of 10 to 20,000.

13. The micro-droplet emulsifier of claim 1, wherein the length and the width of each primary-micro-channel are configured to generate microdroplets with diameters in the range of 5 microns to 200 microns.

14. The micro-droplet-emulsifier of claim 1, wherein the micro-droplet-generator-head has a hexagonal cross-sectional shape with a flat bottom-wall and six side walls, and wherein the plurality of micro-channels are made in the bottom-wall and in the six side walls.

* * * * *